US011315500B2

(12) United States Patent
Xiao

(10) Patent No.: US 11,315,500 B2
(45) Date of Patent: Apr. 26, 2022

(54) DISPLAY DEVICE SYSTEM CIRCUIT AND DISPLAY DEVICE

(71) Applicant: SHENZHEN CHINA STAR OPTOELECTRONICS TECHNOLOGY CO., LTD., Guangdong (CN)

(72) Inventor: Jianfeng Xiao, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 318 days.

(21) Appl. No.: 16/608,494

(22) PCT Filed: Jul. 3, 2019

(86) PCT No.: PCT/CN2019/094620
§ 371 (c)(1),
(2) Date: Oct. 25, 2019

(87) PCT Pub. No.: WO2020/215491
PCT Pub. Date: Oct. 29, 2020

(65) Prior Publication Data

US 2021/0358425 A1 Nov. 18, 2021

(30) Foreign Application Priority Data

Apr. 23, 2019 (CN) ..... 201910330472.6

(51) Int. Cl.
*G09G 3/34* (2006.01)
*G09G 3/36* (2006.01)

(52) U.S. Cl.
CPC ..... *G09G 3/3406* (2013.01); *G09G 3/3696* (2013.01); *G09G 2300/0426* (2013.01)

(58) Field of Classification Search
CPC combination set(s) only.
See application file for complete search history.

(56) References Cited

U.S. PATENT DOCUMENTS 9,362,412 B2 * 6/2016 Umezaki ..... H01L 21/477
2008/0117157 A1 * 5/2008 Hwang ..... G11C 19/184 345/92
2008/0204398 A1 * 8/2008 Hwang ..... H05B 41/2824 345/102
2008/0258998 A1 * 10/2008 Miyake ..... G11C 19/00 345/42
2010/0065844 A1 * 3/2010 Tokunaga ..... H01L 23/564 257/43

* cited by examiner

*Primary Examiner* — Van N Chow

(57) ABSTRACT

A display device system circuit and a display device are provided. The display device system circuit includes a power supply, a plurality of functional circuit modules and a plurality of ground wires corresponding to the plurality of functional circuit modules, respectively. Operating current input ends of the plurality of functional circuit modules are electrically connected to a positive electrode of the power supply, respectively. An operating current output end of each of the functional circuit modules is electrically connected to a negative electrode of the power supply via a corresponding ground wire. The functional circuit modules will not be interfered with each other, avoiding causing abnormal displaying by signal coupling between the functional circuit modules.

11 Claims, 2 Drawing Sheets

DISPLAY DEVICE SYSTEM CIRCUIT AND DISPLAY DEVICE

BACKGROUND

1. Field of Disclosure

The present invention relates to display technologies, and more particularly to a display device system circuit and a display device.

2. Description of Related Art

With the development of display technologies, flat display devices such as liquid crystal displays (LCD) have advantages of high resolution, power saving, small thickness, wide range of application and so on, and thus become a mainstream of display devices and are widely applied to various consumer electronics such as cell phones, TVs, personal digital assistants (PDAs), digital cameras, notebook computers, desktop computers Most of the liquid crystal display devices in the market are of a backlight type, which includes a liquid crystal panel and a backlight module.

Generally, there are a plurality of functional circuit modules disposed in the existing liquid crystal display devices, for example, a backlight control circuit module configured to control the backlight module, a primary control circuit module configured to control various functional circuit modules and a power amplifier circuit module configured for power amplification. All of these circuit modules need a power supply to supply electric power to them to be able to function normally.

FIG. 1 is a diagram showing an existing liquid crystal display device system circuit. The liquid crystal display device system circuit includes a power supply 100, a power amplifier circuit module 200, a primary control circuit module 300 and a backlight control circuit module 400. The operating current input end of the power amplifier circuit module 200, the operating current input end of the primary control circuit module 300 and the operating current input end of the backlight control circuit module 400 are electrically connected to a positive electrode of the power supply 100. The operating current output end of the power amplifier circuit module 200, the operating current output end of the primary control circuit module 300 and the operating current output end of the backlight control circuit module 400 are electrically connected a first node a, a second node b and a third node c of a same ground wire 500, respectively. The first node a, the second node b and the third node c are sequentially disposed. An end of the ground wire 500 close to the first node a is electrically connected to a negative electrode of the power supply 100. Accordingly, the ground wire 500 is shared so as to electrically connect the operating current output end of the power amplifier circuit module 200, the operating current output end of the primary control circuit module 300 and the operating current output end of the backlight control circuit module 400 to the negative electrode of the power supply 100. In this way, operating current outputted by each of the operating current output end of the power amplifier circuit module 200, the operating current output end of the primary control circuit module 300 and the operating current output end of the backlight control circuit module 400 goes back to the negative electrode of the power supply 100 to form a loop.

However, it is inevitable for the ground wire 500 to have impedance such that the potential at every position for the ground wire 500 is affected by operating current outputted by the operating current output ends of the power amplifier circuit module 200, the primary control circuit module 300 and the backlight control circuit module 400. Specifically, the potential of the first node a on the ground wire 500 satisfies $U_a=(i_{10}+i_{20}+i_{30})\times Z_{10}$, where $U_a$ is the potential of the first node a, iso is the operating current of the power amplifier circuit module 200, $i_{20}$ is the operating current of the primary control circuit module 300, $i_{30}$ is the operating current of the backlight control circuit module 400 and $Z_{10}$ is a resistor between the first node a and an end of the ground wire 500 connecting to the negative electrode of the power supply 100; the potential of the second node b on the ground wire 500 satisfies $U_b=U_a+(i_{20}+i_{30})\times Z_{20}=(i_{10}+i_{20}+i_{30})\times Z_{10}+(i_{20}+i_{30})\times Z_{20}$, where $U_b$ is the potential of the second node b and $Z_{20}$ is a resistor between the first node a and the second node b of the ground wire 500; the potential of the third node c on the ground wire 500 satisfies $U_c=U_a+U_b+i_{30}\times Z_{30}=(i_{10}+i_{20}+i_{30})\times Z_{10}+(i_{20}+i_{30})\times Z_{20}+i_{30}\times Z_{30}$, where $U_c$ is the potential of the third node c and $Z_{30}$ is a resistor between the second node b and the third node c of the ground wire 500. Obviously, the potential of the first node a, the second node b and the third node c is related to the operating current $i_{10}$ of the power amplifier circuit module 200, the operating current $i_{20}$ of the primary control circuit module 300 and the operating current $i_{30}$ of the backlight control circuit module 400. The potential on the ground wire 300 varies as the operating current of the power amplifier circuit module 200, the primary control circuit module 300 and the backlight control circuit module 400 is varied. The potential of the operating current output end of each of the power amplifier circuit module 200, the primary control circuit module 300 and the backlight control circuit module 400 is affected by the operating current of the other two. In this way, signals of each of the power amplifier circuit module 200, the primary control circuit module 300 and the backlight control circuit module 400 will be coupled with signals of the other two, causing abnormal phenomena such as power amplifier noise, screen noise points and flickers.

SUMMARY

An objective of the present invention is to provide a display device system circuit, in which functional circuit modules will not be interfered with each other, avoiding causing abnormal displaying by signal coupling between the functional circuit modules.

Another objective of the present invention is to provide a display device, in which functional circuit modules of a system circuit of the display device will not be interfered with each other, avoiding causing abnormal displaying by signal coupling between the functional circuit modules.

To achieve above objectives, the present invention provides a display device system circuit, including a power supply, a plurality of functional circuit modules and a plurality of ground wires corresponding to the plurality of functional circuit modules, respectively, wherein operating current input ends of the plurality of functional circuit modules are electrically connected to a positive electrode of the power supply, respectively, and an operating current output end of each of the functional circuit modules is electrically connected to a negative electrode of the power supply via a corresponding ground wire.

The number of the plurality of functional circuit modules is three.

The plurality of functional circuit modules includes a primary control circuit module, a backlight control circuit module electrically connected to the primary control circuit module and a power amplifier circuit module electrically connected to the primary control circuit module.

The primary control circuit module has a first control signal output end electrically connected to a control end of the power amplifier circuit module and is configured to transmit a power amplifier control signal to the control end of the power amplifier circuit module via the first control signal output end.

The primary control circuit module has a second control signal output end electrically connected to a control end of the backlight control circuit module and is configured to transmit a backlight control signal to the control end of the backlight control circuit module via the second control signal output end.

The display device system circuit further includes a printed circuit board, wherein the plurality of functional circuit modules and the plurality of ground wires are all disposed on the printed circuit board.

The potential of an operating current output end of each functional circuit module is equal to the product of an operating current outputted by the operating current output end of the functional circuit module and the resistance of a corresponding ground wire located between the operating current output end of the functional circuit module and the negative electrode of the power supply.

An end of each of the ground wires is electrically connected to the operating current output end of a corresponding functional circuit module and the other end is electrically connected to the negative electrode of the power supply.

The present invention further provides a display device which includes the aforesaid display device system circuit.

The display device is a liquid crystal display device.

The beneficial effects of the present invention are described below. The display device system circuit of the present invention includes a power supply, a plurality of functional circuit modules and a plurality of ground wires corresponding to the plurality of functional circuit modules, respectively. Operating current input ends of the plurality of functional circuit modules are electrically connected to a positive electrode of the power supply, respectively. An operating current output end of each of the functional circuit modules is electrically connected to a negative electrode of the power supply via a corresponding ground wire. This can make the functional circuit modules not be interfered with each other, avoiding causing abnormal displaying by signal coupling between the functional circuit modules. The functional circuit modules of the display device system circuit of the present invention will not be interfered with each other, avoiding causing abnormal displaying by signal coupling between the functional circuit modules.

BRIEF DESCRIPTION OF DRAWINGS

To make the features and technical content of the present invention be understood in a further step, please refer to the detailed description and appended drawings related to the present invention below; however, the appended drawings are merely for reference and illustration and are not intended to limit the present invention.

In the appended drawings—

DETAILED DESCRIPTION OF PREFERRED EMBODIMENTS

To further explain the technical solutions adopted by the present invention and the effects thereof, the present invention will be described in detail below with reference to preferred embodiments and appended drawings thereof.

Figure 1:
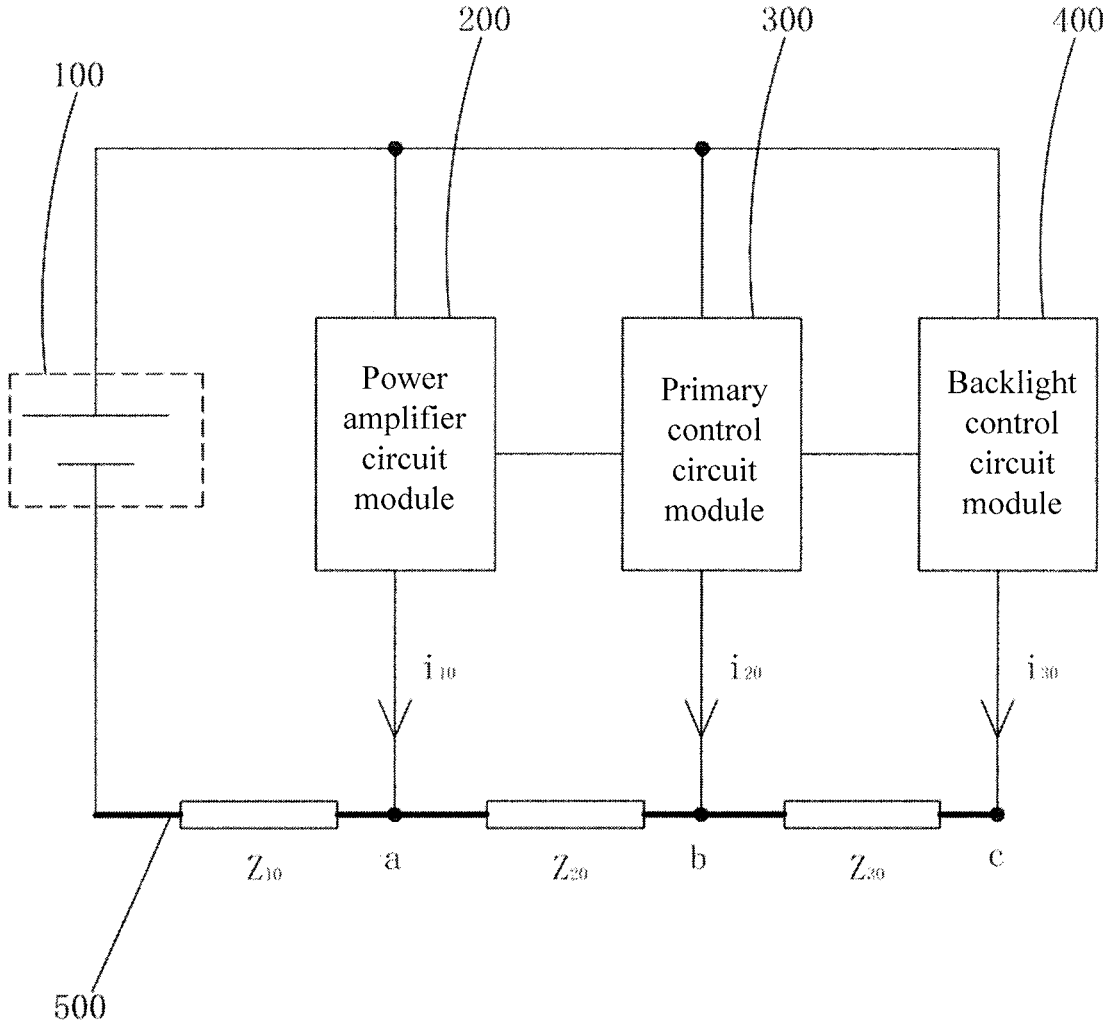
FIG. 1 is a structural diagram showing an existing liquid crystal display device system circuit.
Figure 2:
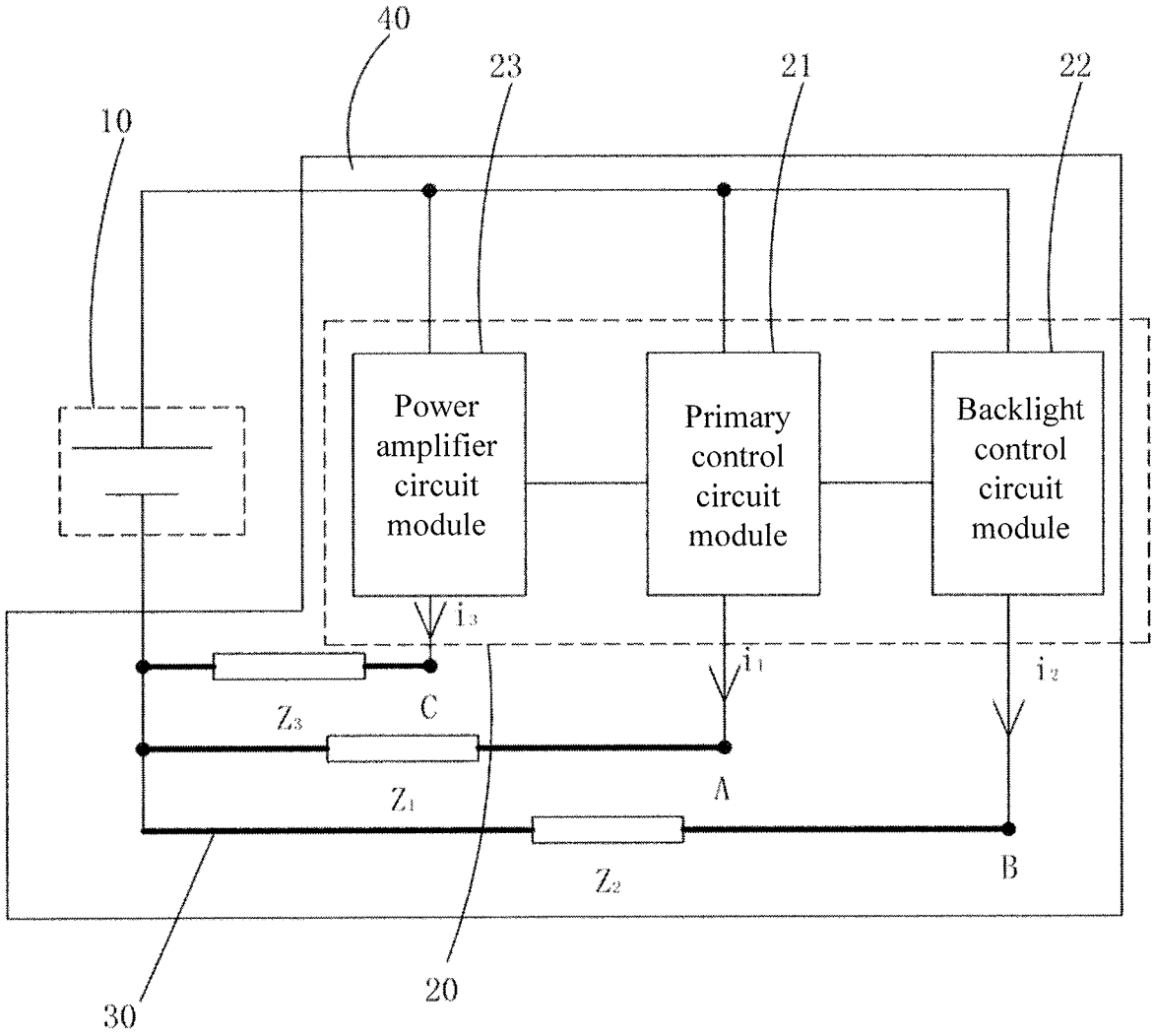
FIG. 2 is a structural diagram showing a display device system circuit of the present invention.

Referring to FIG. 2, the present invention provides a display device system circuit, which includes a power supply 10, a plurality of functional circuit modules 20 and a plurality of ground wires corresponding to the plurality of functional circuit modules 20, respectively. Operating current input ends of the plurality of functional circuit modules 20 are electrically connected to a positive electrode of the power supply 10. An operating current output end of each of the functional circuit modules 20 is electrically connected to a negative electrode of the power supply 10 via a corresponding ground wire 30.

Specifically, the number of the plurality of functional circuit modules 20 is three.

Further, referring to FIG. 2, the plurality of functional circuit modules 20 includes a primary control circuit module 21, a backlight control circuit module 22 electrically connected to the primary control circuit module 21 and a power amplifier circuit module 23 electrically connected to the primary control circuit module 21.

Further, a first control signal output end of the primary control circuit module 21 is electrically connected to a control end of the power amplifier circuit module 23 and is configured to transmit a power amplifier control signal to the control end of the power amplifier circuit module 23. A second control signal output end of the primary control circuit module 21 is electrically connected to a control end of the backlight control circuit module 22 and is configured to transmit a backlight control signal to the control end of the backlight control circuit module 22.

Specifically, referring to FIG. 2, the display device system circuit further includes a printed circuit board 40. The plurality of functional circuit modules 20 and the plurality of ground wires 30 are all disposed on the printed circuit board 40.

Specifically, the potential of the operating current output end of each functional circuit module 20 is equal to the product of an operating current outputted by the operating current output end of the functional circuit module 20 and the resistance of a corresponding ground wire 30 located between the operating current output end of the functional circuit module 20 and the negative electrode of the power supply 10.

Preferably, referring to FIG. 2, one end of each ground wire 30 is electrically connected to the operating current output end of a corresponding functional circuit module 20 and the other end is electrically connected to the negative electrode of the power supply 10.

Taking the embodiment illustrated in FIG. 2 for example, it is noted that the backlight control circuit module 22 pertains to a high-power circuit module, the primary control circuit module 21 pertains to a module with weak signals, and signals from the power amplifier circuit module 23 are weaker and are easy to be interfered. By utilizing single-point grounding, the layout between the negative electrode of the power supply 10 and all of the operating current output end of the primary control circuit module 21, the operating current output end of the backlight control circuit module 22 and the operating current output end of the power amplifier circuit module 23 is changed to a separated deployment in the present invention. That is, the operating current output end of the primary control circuit module 21, the operating current output end of the backlight control circuit module 22 and the operating current output end of the power amplifier circuit module 23 are electrically connected to the negative electrode of the power supply 10 via three individually disposed ground wires 30, respectively. Accordingly, the potential of a first node A, electrically connected to the operating current output end of the primary control circuit module 21, of a ground wire 30 corresponding to the primary control circuit module 21 satisfies $U_A=i_1\times Z_1$, where $U_A$ is the potential of the first node A, $i_1$ is the operating current outputted by the operating current output end of the primary control circuit module 21 and $Z_1$ is the resistance of the corresponding ground wire 30 located between the first node A and the negative electrode of the power supply 10; the potential of a second node B, electrically connected to the operating current output end of the backlight control circuit module 22, of a ground wire 30 corresponding to the backlight control circuit module 22 satisfies $U_B=i_2\times Z_2$, where $U_B$ is the potential of the second node B, $i_2$ is the operating current outputted by the operating current output end of the backlight control circuit module 22 and $Z_2$ is the resistance of the corresponding ground wire 30 located between the second node B and the negative electrode of the power supply 10; the potential of a third node C, electrically connected to the operating current output end of the power amplifier circuit module 23, of a ground wire 30 corresponding to the power amplifier circuit module 23 satisfies $U_C=i_3\times Z_3$, where $U_C$ is the potential of the third node C, $i_3$ is the operating current outputted by the operating current output end of the power amplifier circuit module 23 and $Z_3$ is the resistance of the corresponding ground wire 30 located between the third node C and the negative electrode of the power supply 10. It can be seen that the potential of the first node A, the second node B and the third node C is only related to the operating current outputted by the corresponding functional circuit module 20 and the resistance of the corresponding ground wire 30. That is, the potential of the operating current output end of each functional circuit module 20 is only related to the outputted operating current and the resistance of the corresponding ground wire 30, and will not be interfered by the operating current outputted by other functional circuit modules 20. Accordingly, signal coupling caused between different functional circuit modules 20 can be avoided, thereby avoiding abnormal phenomena such as power amplifier noise, screen noise points and flickers, and improving display quality of the display device.

Based on a same inventive concept, the present invention further provides a display device including the aforesaid display device system circuit shown in FIG. 2. The structure of the display device system circuit is not repeated herein.

Specifically, the display device is a liquid crystal display device.

Taking the embodiment illustrated in FIG. 2 for example, it is noted that the backlight control circuit module 22 pertains to a high-power circuit module, the primary control circuit module 21 pertains to a module with weak signals, and signals from the power amplifier circuit module 23 are weaker and are easy to be interfered. By utilizing single-point grounding, the layout between the negative electrode of the power supply 10 and all of the operating current output end of the primary control circuit module 21, the operating current output end of the backlight control circuit module 22 and the operating current output end of the power amplifier circuit module 23 is changed to a separated deployment in the present invention. That is, the operating current output end of the primary control circuit module 21, the operating current output end of the backlight control circuit module 22 and the operating current output end of the power amplifier circuit module 23 are electrically connected to the negative electrode of the power supply 10 via three individually disposed ground wires 30, respectively. Accordingly, the potential of a first node A, electrically connected to the operating current output end of the primary control circuit module 21, of a ground wire 30 corresponding to the primary control circuit module 21 satisfies $U_A=i_1\times Z_1$, where $U_A$ is the potential of the first node A, $i_1$ is the operating current outputted by the operating current output end of the primary control circuit module 21 and $Z_1$ is the resistance of the corresponding ground wire 30 located between the first node A and the negative electrode of the power supply 10; the potential of a second node B, electrically connected to the operating current output end of the backlight control circuit module 22, of a ground wire 30 corresponding to the backlight control circuit module 22 satisfies $U_B=i_2\times Z_2$, where $U_B$ is the potential of the second node B, $i_2$ is the operating current outputted by the operating current output end of the backlight control circuit module 22 and $Z_2$ is the resistance of the corresponding ground wire 30 located between the second node B and the negative electrode of the power supply 10; the potential of a third node C, electrically connected to the operating current output end of the power amplifier circuit module 23, of a ground wire 30 corresponding to the power amplifier circuit module 23 satisfies $U_C=i_3\times Z_3$, where $U_C$ is the potential of the third node C, $i_3$ is the operating current outputted by the operating current output end of the power amplifier circuit module 23 and $Z_3$ is the resistance of the corresponding ground wire 30 located between the third node C and the negative electrode of the power supply 10. It can be seen that the potential of the first node A, the second node B and the third node C is only related to the operating current outputted by the corresponding functional circuit module 20 and the resistance of the corresponding ground wire 30. That is, the potential of the operating current output end of each functional circuit module 20 is only related to the outputted operating current and the resistance of the corresponding ground wire 30, and will not be interfered by the operating current outputted by other functional circuit modules 20. Accordingly, signal coupling caused between different functional circuit modules 20 can be avoided, thereby avoiding abnormal phenomena such as power amplifier noise, screen noise points and flickers, and improving display quality of the display device.

Above all, the display device system circuit of the present invention includes a power supply, a plurality of functional circuit modules and a plurality of ground wires corresponding to the plurality of functional circuit modules, respectively. Operating current input ends of the plurality of functional circuit modules are electrically connected to a positive electrode of the power supply, respectively. An operating current output end of each of the functional circuit modules is electrically connected to a negative electrode of the power supply via a corresponding ground wire. This can make the functional circuit modules not be interfered with each other, avoiding causing abnormal displaying by signal coupling between the functional circuit modules. The functional circuit modules of the display device system circuit of the present invention will not be interfered with each other, avoiding causing abnormal displaying by signal coupling between the functional circuit modules.

Based on the description given above, those having ordinary skills of the art may easily contemplate various changes and modifications of the technical solution and technical ideas of the present application and all these changes and modifications are considered within the protection scope of right for the present application.

The invention claimed is:

1. A display device system circuit, comprising a power supply, a plurality of functional circuit modules and a plurality of ground wires corresponding to the plurality of functional circuit modules, respectively, wherein operating current input ends of the plurality of functional circuit modules are electrically connected to a positive electrode of the power supply, respectively, and an operating current output end of each of the functional circuit modules is electrically connected to a negative electrode of the power supply via a corresponding ground wire, wherein the plurality of functional circuit modules comprises a primary control circuit module, a backlight control circuit module electrically connected to the primary control circuit module and a power amplifier circuit module electrically connected to the primary control circuit module, wherein the primary control circuit module has a first control signal output end electrically connected to a control end of the power amplifier circuit module and is configured to transmit a power amplifier control signal to the control end of the power amplifier circuit module via the first control signal output end, wherein the primary control circuit module has a second control signal output end electrically connected to a control end of the backlight control circuit module and is configured to transmit a backlight control signal to the control end of the backlight control circuit module via the second control signal output end, wherein the operating current output end of the primary control circuit module, the operating current output end of the backlight control circuit module and the operating current output end of the power amplifier circuit module are electrically connected to the negative electrode of the power supply via three individually disposed ground wires, respectively.

2. The display device system circuit according to claim 1, wherein the number of the plurality of functional circuit modules is three.

3. The display device system circuit according to claim 1, further comprising a printed circuit board, wherein the plurality of functional circuit modules and the plurality of ground wires are all disposed on the printed circuit board.

4. The display device system circuit according to claim 1, wherein the potential of an operating current output end of each functional circuit module is equal to the product of an operating current outputted by the operating current output end of the functional circuit module and the resistance of a corresponding ground wire located between the operating current output end of the functional circuit module and the negative electrode of the power supply.

5. The display device system circuit according to claim 1, wherein an end of each of the ground wires is electrically connected to the operating current output end of a corresponding functional circuit module and the other end is electrically connected to the negative electrode of the power supply.

6. A display device, comprising a display device system circuit, the display device system circuit comprising a power supply, a plurality of functional circuit modules and a plurality of ground wires corresponding to the plurality of functional circuit modules, respectively, wherein operating current input ends of the plurality of functional circuit modules are electrically connected to a positive electrode of the power supply, respectively, and an operating current output end of each of the functional circuit modules is electrically connected to a negative electrode of the power supply via a corresponding ground wire, wherein the plurality of functional circuit modules comprises a primary control circuit module, a backlight control circuit module electrically connected to the primary control circuit module and a power amplifier circuit module electrically connected to the primary control circuit module, wherein the primary control circuit module has a first control signal output end electrically connected to a control end of the power amplifier circuit module and is configured to transmit a power amplifier control signal to the control end of the power amplifier circuit module via the first control signal output end, wherein the primary control circuit module has a second control signal output end electrically connected to a control end of the backlight control circuit module and is configured to transmit a backlight control signal to the control end of the backlight control circuit module via the second control signal output end, wherein the operating current output end of the primary control circuit module, the operating current output end of the backlight control circuit module and the operating current output end of the power amplifier circuit module are electrically connected to the negative electrode of the power supply via three individually disposed ground wires, respectively.

7. The display device according to claim 6, wherein the display device is a liquid crystal display device.

8. The display device according to claim 6, wherein the number of the plurality of functional circuit modules is three.

9. The display device according to claim 6, wherein the display device system circuit further comprises a printed circuit board, wherein the plurality of functional circuit modules and the plurality of ground wires are all disposed on the printed circuit board.

10. The display device according to claim 6, wherein the potential of an operating current output end of each functional circuit module is equal to the product of an operating current outputted by the operating current output end of the functional circuit module and the resistance of a corresponding ground wire located between the operating current output end of the functional circuit module and the negative electrode of the power supply.

11. The display device according to claim 6, wherein an end of each of the ground wires is electrically connected to the operating current output end of a corresponding functional circuit module and the other end is electrically connected to the negative electrode of the power supply.

* * * * *